United States Patent [19]

Trautwein

[11] 4,057,865

[45] Nov. 15, 1977

[54] FOLDABLE KAYAK

[76] Inventor: Robert Trautwein, 2048 N. 32nd St., Milwaukee, Wis. 53208

[21] Appl. No.: 701,112

[22] Filed: June 30, 1976

[51] Int. Cl.[2] ..... B63B 7/06

[52] U.S. Cl. ..... 9/2 F; 9/1.4; 9/2 A

[58] Field of Search ..... 9/1.1, 1.4, 6 P, 2 F, 9/2 C, 2 A, 2 R, 2 S

[56] References Cited

U.S. PATENT DOCUMENTS

| | | | |
|---|---|---|---|
| 247,827 | 10/1881 | Hunt et al. | 9/2 A |
| 1,084,320 | 1/1914 | DuBois | 9/2 A |
| 1,631,047 | 5/1927 | Meyer | 9/2 A |
| 2,338,976 | 1/1944 | Schütte | 9/2 A |
| 3,099,024 | 7/1963 | Lewis | 9/2 A |
| 3,287,754 | 11/1966 | Price et al. | 9/310 E |
| 3,497,887 | 3/1970 | Bureau, Jr. | 9/6 P |
| 3,724,011 | 4/1973 | Scholle | 9/2 F |

*Primary Examiner*—Trygve M. Blix
*Assistant Examiner*—Stuart M. Goldstein
*Attorney, Agent, or Firm*—Andrus, Sceales, Starke & Sawall

[57] ABSTRACT

A rigid bottom foldable on a central transverse hinge has a removable tubular skeleton frame at each end supporting the skin. A pneumatic tubular member carried by the bottom sections serves to expand and tightly support the skin in use, thereby retaining the frame in assembled relation to the bottom.

9 Claims, 10 Drawing Figures

Fig. 3
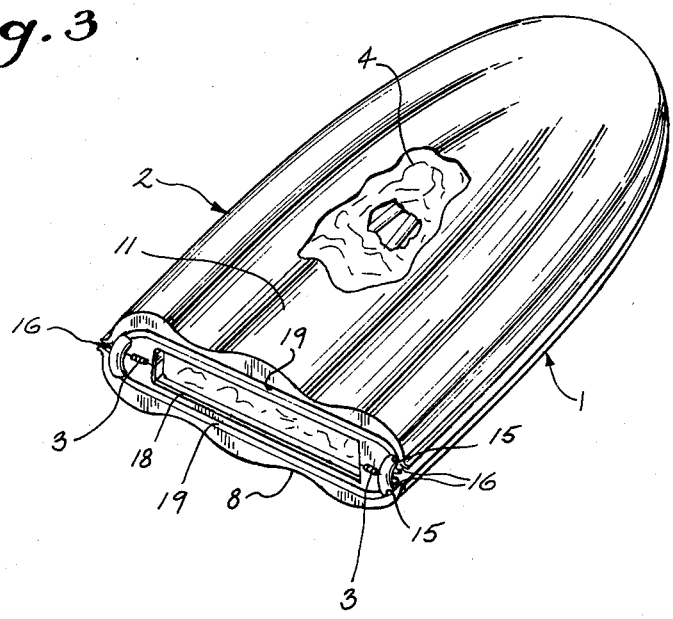
Fig. 6
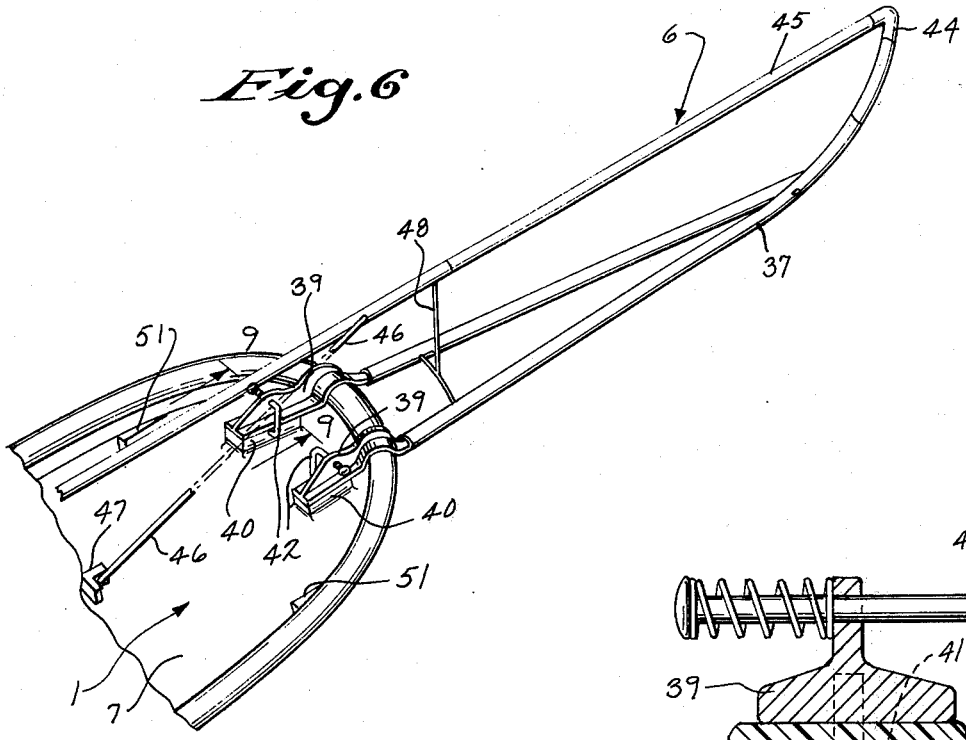
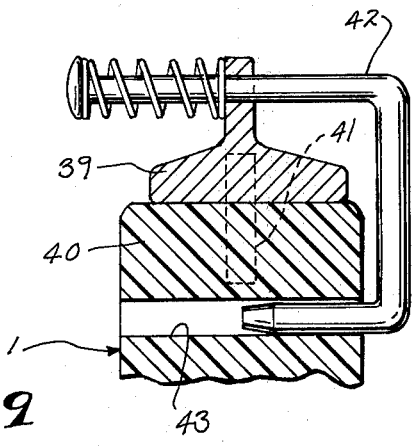
Fig. 9

FOLDABLE KAYAK

BACKGROUND OF THE INVENTION

This invention relates to a foldable kayak which can be stored in a small space and can be readily transported inside the normal passenger motor vehicle.

Various proposals have been made to provide foldable kayaks, ranging from an inflatable rubber raft type of construction to a complete knock-down skeleton frame with removable skin.

The former construction poses difficulties in proper use of the kayak due to the flexibility involved, while the latter construction involves considerable time in assembling and disassembling the parts.

SUMMARY OF THE INVENTION

It is proposed herein to provide a rigid bottom in two parts hinged on a central transverse vertical plane for support of the occupant without distortion of the water contacting surfaces of the kayak, and to provide removable skeleton frame members at each end and at the top to support the skin.

A pneumatic expandable tubular member extends along each side of the rigid bottom parts to tighten the skin on the frame.

The pneumatic member and the skin are secured to the bottom members and fold into the space provided between the bottom members when the latter are folded for storage or transportation.

The removable frame members are in relatively short pieces which can be disposed in the space between the bottom members when the latter are folded.

BRIEF DESCRIPTION OF THE DRAWINGS

The accompanying drawings illustrate the best mode presently contemplated for carrying out the invention.

In the drawing:

FIG. 3 is a perspective view showing the kayak in collapsed folded condition;

FIG. 6 is a detail perspective view showing the end frame secured to the end of one of the bottom members;

FIG. 9 is a detail section showing the manner of securing a frame member upon its mounting and taken on line 9—9 of FIG. 6.

DESCRIPTION OF THE PREFERRED EMBODIMENT

Figure 1:
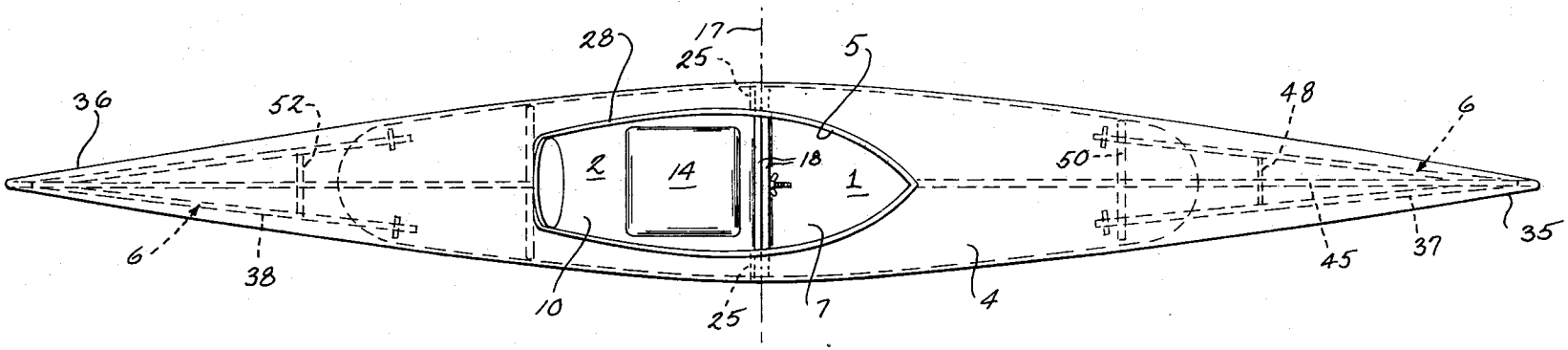
FIG. 1 is a top plan view of the kayak.
Figure 2:
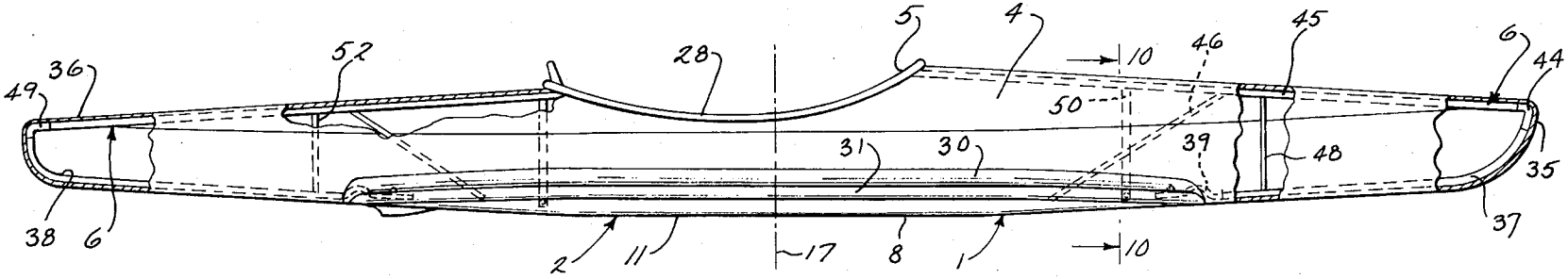
FIG. 2 is a side elevation of the kayak of FIG. 1 with parts broken away to show details of construction.
Figure 4:
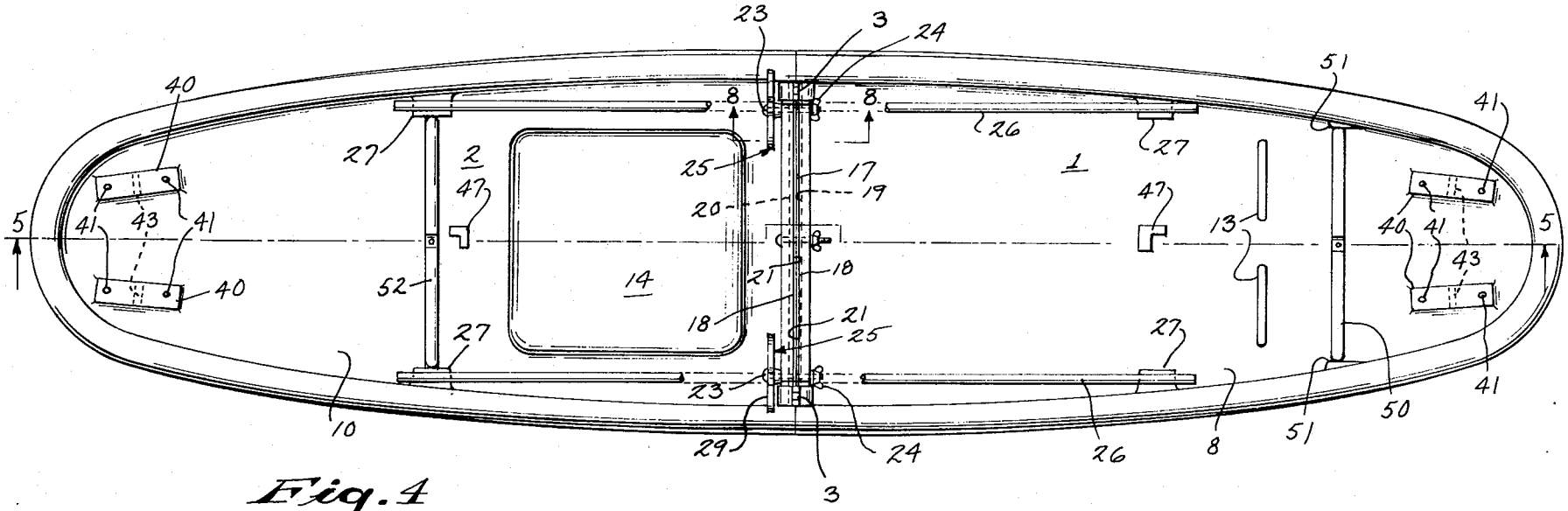
FIG. 4 is a top plan view of the two bottom members in extended position.
Figure 5:
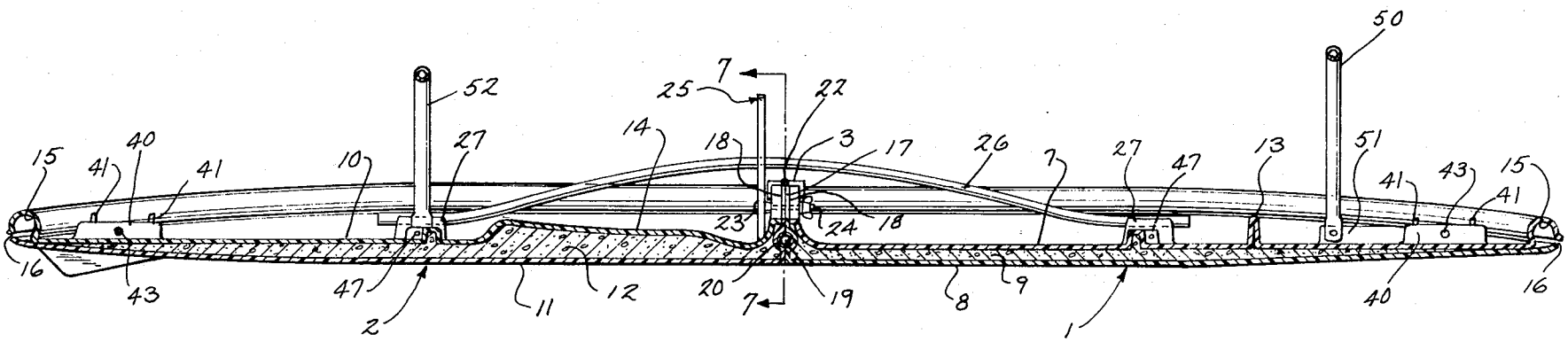
FIG. 5 is a central vertical longitudinal section of the bottom members taken on line 5—5 of FIG. 4.
Figure 7:
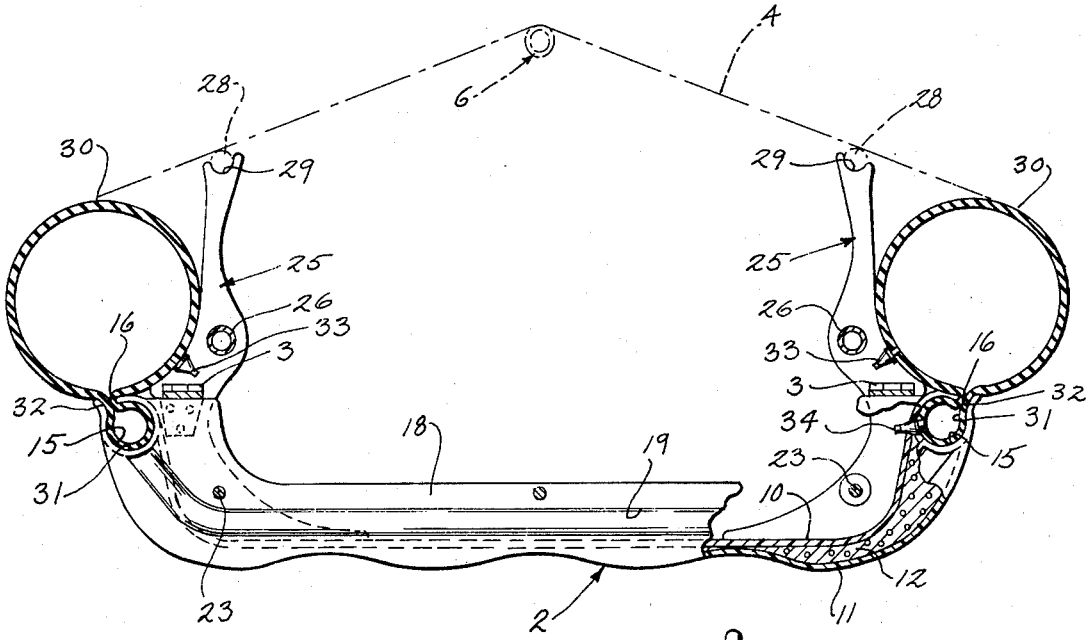
FIG. 7 is a transverse vertical section taken on line 7—7 of FIG. 5.
Figure 8:
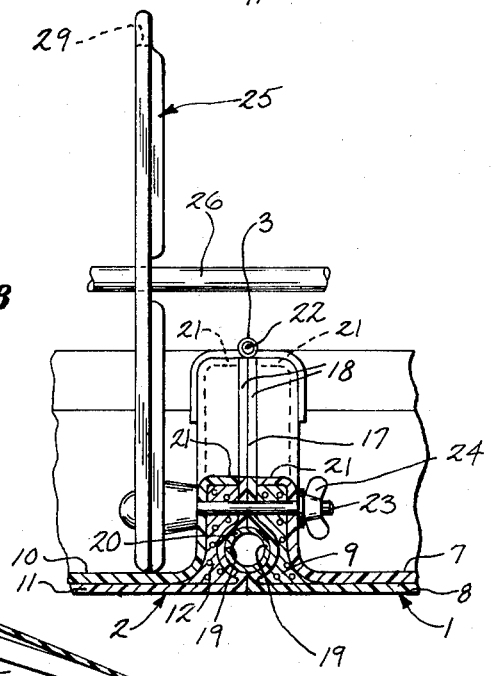
FIG. 8 is an enlarged detail section taken on line 8—8 of FIG. 4.
Figure 10:
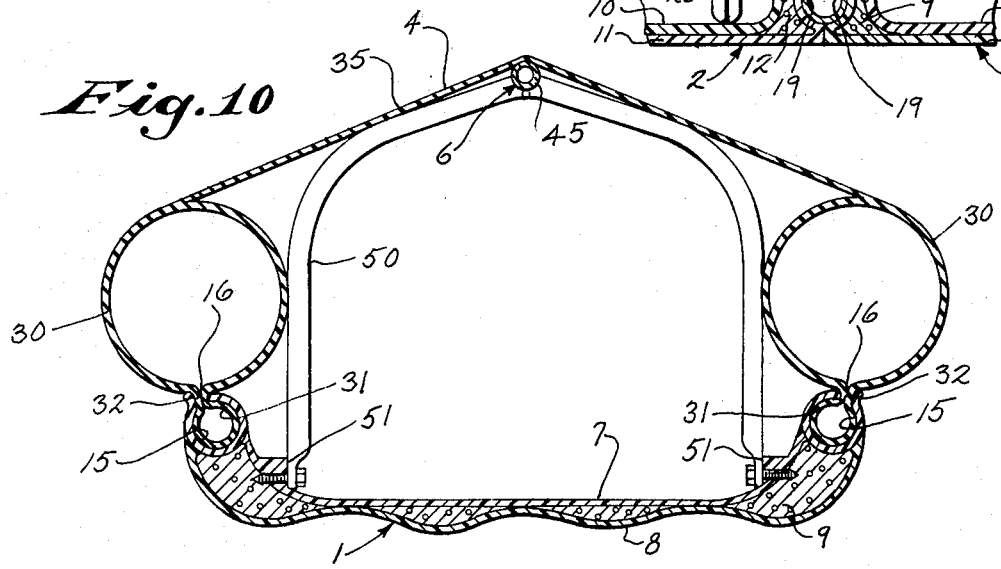
FIG. 10 is a transverse vertical section taken on line 10—10 of FIG. 2.

The kayak illustrated in the drawings comprises in general a rigid bottom formed in two parts 1 and 2 foldably secured together by hinges 3, a flexible skin 4 secured to the opposite sides of the bottom parts 1 and 2 and extending over the same with a central opening 5 in the top to accommodate an operator, and end frames

6 removably secured to the corresponding opposite ends of the bottom to support the skin.

The front bottom part 1 is constructed of separately molded upper and lower sheets 7 and 8 of co-polymerized acrylonitrile butadiene styrene, or the like, assembled and secured together by a polyurethane foam filling 9 therebetween.

Similarly, the rear bottom part 2 is constructed of separately molded upper and lower sheets 10 and 11 of co-polymerized acrylonitrile butadiene styrene, or the like, assembled and secured together by a polyurethane foam filling 12 therebetween.

The spacing of the upper and lower sheets 7 and 8 for the front section 1 and the upper and lower sheets 10 and 11 for the rear section 2 and the thickness of the polyurethane foam 12 therebetween is such as to provide the necessary rigidity for the bottom of the kayak to support the operator without distortion.

The upper sheet 7 of the front section 1 has an upstanding transverse ridge constituting a foot rest 13 for the operator.

The upper sheet 10 of the rear section 2 has a raised portion contoured to form a seat 14 for the operator.

The opposite sides of sections 1 and 2 are curved upwardly to a level substantially above the bottom of the sections and the opposed edge portions of the upper and lower sheets 7 and 8, and 10 and 11, respectively, are formed to provide a substantially tubular cavity 15 of generally circular cross section therebetween with a narrow slit 16 extending longitudinally thereof along each side of the section and around the outer free end thereof.

The bottom of each section 1 and 2 is inclined upwardly toward the cavity 15 at the free end of the section.

The sections 1 and 2 are joined by hinges 3 disposed generally in a transverse vertical central parting plane 17 between the sections.

For this purpose each lower sheet 8 and 11 has a vertical flange 18 extending transversely at parting plane 17 between the side cavities 15 and formed with a groove 19 extending near the bottom of the section for the full width thereof.

The grooves 19 are complimentary for receiving a suitable generally tubular sealing member 20 compressed therein when the sections are extended.

The upper sheets 7 and 10 have their meeting edge portions 21 formed upwardly and then horizontally to engage the edge portions of the corresponding flanges 18 above the grooves 19.

The edge portions 21 extend upwardly near the cavities 15 to provide a support for the strap hinges 3 secured thereto with the pivot axes 22 for the hinges at a level above all other parts of sections 1 and 2 whereby the latter are free to pivot upwardly thereon to the folded position of FIG. 3.

In order to secure the sections 1 and 2 in extended position a bolt 23 with a wing nut 24 thereon extends through the upwardly flanged edge portions 21 and flanges 18 beneath each hinge 3. A similar bolt is disposed at the longitudinal center line of sections 1 and 2. Additionally each bolt 23 and wing nut 24 secures a vertical aluminum support casting 25 which rests upon the sheet 10 adajcent edge portion 21 and extends upwardly with a reinforcing rod 26 extending therethrough at a level generally above the corresponding hinge 3. The opposite ends of rod 26 bear down resiliently upon a recessed ledge 27 formed in the corresponding upper sheet 7 or 10 to prevent collapse of sections 1 and 2 upon hinges 3.

The skin 4 is in one piece with a reinforcing rim 28 around top opening 5 supported on opposite sides in recesses 29 at the upper ends of the corresponding support castings 25.

The side edges of skin 4 are secured to corresponding inflatable tubes 30 as by stitching and sealing.

The tubes 30 are of relatively large diameter and formed integrally with a smaller diameter support tube 31 which is also inflatable.

Tubes 30 and 31 are joined together by a short web 32 so that when support tube 31 is inflated within cavity 15 tube 30 is held directly by the mouth of slit 16.

Suitable inflation valves 33 are connected to tubes 30 inside the kayak near the operator position and a similar inflation valve 34 is connected to tube 31 inside the kayak and near the operator position for ready inflation of the tubes.

The support tube 31 continues around the free end of each of the sections 1 and 2 and is always confined in the cavity 15.

The outer inflated tubes 30 extend continuously along each side of sections 1 and 2 for substantially the full length of the sections.

The skin 4 extends beyond the sections 1 and 2 to form the bow 35 and the stern 36 of the kayak.

Both the bow 35 and stern 36 portions of the skin 4 constitute extensions of the bottom of the kayak, with the bottom portion secured and sealed to the support tube 31.

As the kayak narrows from the central widest part the side edges of skin 4 become wrapped further around the tubes 30 and then around the support tube 31 to provide a continuous water-tight enclosure for the kayak.

The bow and stern enclosures 35 and 36 formed by skin 4 are shaped substantially to a point by removable unitary support frames 37 and 38, respectively.

The support frame 37 for bow 35 comprises sectional lower tubing extending at a slight incline forwardly from individual side brackets 39 removably secured to corresponding mountings 40 on either side of forward section 1.

Each bracket 39 is telescoped into the end of the corresponding tube of frame 37 and extends over the cavity portion 15 of section 1 to lie flat upon the top of the mounting 40.

Suitable dowels 41 are disposed vertically in mounting 40 and extend upwardly through holes in the bracket 39 to secure the latter against displacement.

The brackets 39 are releasably secured upon their respective mountings 40 by a spring pressed bolt 42 of generally U shape carried by the bracket and having a free end entering a horizontal transverse bore 43 in the mounting as shown in detail in FIG. 9.

At the forward end of frame 37 the side tubes merge into one which then continues upwardly to telescope a shank on a bow bracket 44 at the peak of the bow.

An upper tube 45 telescopes a portion of bracket 44 and extends substantially horizontally rearwardly to the rim 28 to which it is suitably secured.

The upper tube 45 is held in a central longitudinal position of the kayak by a brace 46 extending from a mounting 47 generally central of section 1 upwardly at an angle thereto.

A generally T-shaped brace 48 is removably secured to the lower side tubes of frame 37 and to the upper tube 45 to retain the frame rigid when installed.

The upper tube 45 of frame 37 is additionally supported by an inverted U-shaped brace 50 transverse to section 1 and pivotally bolted to shoulders 51 at either side of sheet 7.

The stern frame 38 is constructed similarly to the bow frame 37 with the exception that the end bracket 49 corresponding to bow bracket 44 is disposed lower down and the end section of tubing supporting it extends vertically rather than inclined.

Also the U-shaped brace 52 which corresponds to brace 50 is pivotally bolted to ledges 27.

The tubes of frames 37 and 38 are sectionalized in lengths of preferably less than three feet and suitably joined together by telescoping connections so that the frames can be readily dismantled and disposed within a small space between bottom sections 1 and 2 when the latter are folded upon the hinges 3.

Likewise the skin 4 is of flexible waterproof fabric which can be readily folded when tubes 30 are deflated and disposed within the space between folded sections 1 and 2, as illustrated in FIG. 3.

Various modes of carrying out the invention are contemplated as being within the scope of the following claims particularly pointing out and distinctly claiming the subject matter which is regarded as the invention.

I claim:

1. A foldable kayak comprising forward bow and rearward stern rigid bottom sections with hinge means joining the same together on a generally central transverse vertical parting plane and extending substantially short of the ends of the kayak, a flexible water tight skin forming the bow and stern of the kayak and extending above said bottom sections with a central opening in the top thereof for access of an operator, inflatable means integral with said skin and mounting the same around the periphery of said bottom section, and separable bow and stern removable frame means carried by said bottom sections, and extending therefrom longitudinally within end portions of said skin to support and shape the bow and stern portions of said skin.

2. The kayak of claim 1 in folded condition wherein said mounting means are deflated and said frame means are removed and said bottom sections are folded upon the hinge therebetween, and said frame means are separated in parts and included along with said deflated mounting means and said skin in the space between said folded bottom sections for ready transportation of the kayak.

3. The kayak of claim 1 in which said rigid bottom sections are separately molded of a synthetic plastic material having the general properties of resilience, rigidity and durability of co-polymerized acrylonitrile butadiene styrene.

4. The kayak of claim 3 in which the molded material is in the form of separate superimposed upper and lower molded sheets with a polyurethane foam therebetween to provide greater rigidity for the bottom sections.

5. The kayak of claim 4 in which the upper of said superimposed sheets for said stern section is molded to provide a seat for the operator of the kayak, and the upper of said superimposed sheets for said bow section is molded to provide a footrest for the operator.

6. The kayak of claim 4 in which the coextensive peripheries of said superimposed sheets are molded to provide a generally tubular space therebetween for receiving a portion of said inflatable skin mounting with an open slot between the peripheral edges for access to said space.

7. The kayak of claim 6 in which said inflatable skin mounting comprises a tubular portion disposed in said space, larger expansible tubular means integral with said first named portion, and means securing said skin to said portions to thereby stretch said skin to conform to the general shape of a kayak.

8. The kayak of claim 1 and a rim extending circumferentially of said top opening in said skin, and said frame means supporting said rim at a predetermined distance above said bottom sections.

9. A three piece foldable kayak comprising central forward bow and rearward stern rigid bottom sections, a hinge means connecting the bottom sections to each other, a unitary bow frame section having quick release means for releasable and separable connection to the forward end of the forward bow bottom section and extending substantially forwardly therefrom, a unitary stern frame section having quick release means for releasable and separable connection to the rearward end of the stern bottom section, a flexible watertight skin sealed to the periphery of said bottom sections and enclosing said bow and stern frame sections, said skin having an opening in the top aligned with said bottom sections, and inflatable means mounted within said skin around the periphery of the bottom section to support and shape said skin including tightening of the same upon the bow and stern portions.

* * * * *